US011536509B2

(12) United States Patent
Signorino et al.

(10) Patent No.: US 11,536,509 B2
(45) Date of Patent: Dec. 27, 2022

(54) SHELF ASSEMBLY AND HOLDING STRUT THEREFOR

(71) Applicant: emz-Hanauer GmbH & Co. KGaA, Nabburg (DE)

(72) Inventors: Manfredi Signorino, Wackersdorf (DE); Martin Brabec, Nabburg (DE); Georg Spiessl, Altendorf (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 0 days.

(21) Appl. No.: 17/223,524

(22) Filed: Apr. 6, 2021

(65) Prior Publication Data

US 2021/0318060 A1 Oct. 14, 2021

(30) Foreign Application Priority Data

Apr. 8, 2020 (DE) ..... 102020109820.0

(51) Int. Cl.
*F25D 25/02* (2006.01)
*A47B 57/42* (2006.01)
(Continued)

(52) U.S. Cl.
CPC ..... *F25D 25/02* (2013.01); *A47B 57/42* (2013.01); *A47B 96/027* (2013.01);
(Continued)

(58) Field of Classification Search
CPC ..... F25D 25/02; F25D 2325/021; F25D 2325/022; F25D 23/067; A47B 96/027; A47B 57/42; A47B 57/14; A47B 57/16; A47B 57/40; A47B 57/56; A47B 96/028; A47B 96/061; A47B 47/022; A47B 96/06; A47B 2220/0077
See application file for complete search history.

(56) References Cited

U.S. PATENT DOCUMENTS 4,157,228 A * 6/1979 Hammerschlag ..... A47B 57/40 403/252
4,341,486 A 7/1982 Hammerschlag
(Continued)

FOREIGN PATENT DOCUMENTS

CA 2440589 C * 2/2011 ..... A47B 96/00
DE 102015007839 A1 12/2016
(Continued)

*Primary Examiner* — Hiwot E Tefera
(74) *Attorney, Agent, or Firm* — Hayes Soloway PC

(57) ABSTRACT

A shelf assembly, in particular for a domestic cooling device, includes a receiving plate having a front plate edge, a rear plate edge and two lateral plate edges, and a holding strut on at least one of the lateral plate edges for supporting the receiving plate. The holding strut has in the region of a rear strut end at least one hook structure for fitting the holding strut into a mounting opening of a carrying structure. At a distance beneath the hook structure, the holding strut forms a first support structure for support on a front side, facing the strut, of the carrying structure. The holding strut, in the region of the rear strut end, at a distance above the first support structure, provides a resiliently deflectable second support structure for support on the front side, facing the strut, of the carrying structure.

13 Claims, 4 Drawing Sheets

(51) Int. Cl.
*A47B 96/06* (2006.01)
*A47B 96/02* (2006.01)

(52) U.S. Cl.
CPC ..... *A47B 96/061* (2013.01); *F25D 2325/021* (2013.01); *F25D 2325/022* (2013.01)

(56) References Cited

U.S. PATENT DOCUMENTS

| | | | | |
|---|---|---|---|---|
| 4,733,841 | A * | 3/1988 | Wilson | A47B 95/008 108/108 |
| 5,034,861 | A | 7/1991 | Sklenak et al. | |
| 5,082,388 | A * | 1/1992 | Lauterbach | A47B 57/40 403/254 |
| 5,346,077 | A * | 9/1994 | Randall | A47B 96/028 211/90.03 |
| 6,024,333 | A * | 2/2000 | Raasch | A47B 55/02 211/90.03 |
| 6,402,106 | B1 | 6/2002 | Padiak | |
| 8,322,873 | B2 | 12/2012 | Glovatsky et al. | |
| 8,596,205 | B2 | 12/2013 | Driver et al. | |
| 8,899,704 | B2 | 12/2014 | Bienick | |
| 9,920,920 | B2 | 3/2018 | Signorino et al. | |
| 9,989,298 | B1 * | 6/2018 | Wantland | A47B 96/061 |
| 9,995,477 | B2 | 6/2018 | Miedema et al. | |
| 10,077,935 | B2 | 9/2018 | Schenkl et al. | |
| 10,724,789 | B2 | 7/2020 | Signorino et al. | |
| 2014/0217879 | A1 | 8/2014 | Kerner | |
| 2014/0376213 | A1 * | 12/2014 | Miedema | F21V 5/04 362/127 |
| 2015/0216062 | A1 | 7/2015 | Theisen et al. | |
| 2016/0161669 | A1 * | 6/2016 | Lee | F25D 25/02 362/621 |
| 2017/0086322 | A1 * | 3/2017 | Schenkl | F21S 4/28 |

FOREIGN PATENT DOCUMENTS

| | | | |
|---|---|---|---|
| DE | 102018002685 | A1 | 10/2019 |
| EP | 3147607 | A1 | 3/2017 |
| GB | 2369288 | A | 5/2002 |
| WO | 2014205352 | A1 | 12/2014 |

* cited by examiner

SHELF ASSEMBLY AND HOLDING STRUT THEREFOR

BACKGROUND OF THE INVENTION

1. Field of the Invention

The present invention relates generally to a shelf assembly and to a holding strut therefor. Additionally, the present invention relates to a storage arrangement which serves for storing items of everyday life or household items and is equipped with a shelf assembly of the type under consideration here.

2. Description of the Prior Art

Domestic refrigerators are conventionally equipped with one or more shelves which, as required, can be inserted into the cold chamber of the refrigerator and removed again, for example for cleaning purposes. The shelves provide receiving surfaces on which foodstuffs which are to be stored in the refrigerator can be received or placed. In particular in the case of higher-quality refrigerators, such shelves are sometimes equipped with a front protective strip (so-called trim in English) in which there are accommodated electric lighting means which serve to illuminate the space above or/and below the shelf or/and to illuminate the shelf itself. The presence of the electric lighting means requires the supply of electric current. The current is conventionally supplied via lateral holding struts to which the shelf is connected to form a shelf assembly and which extend along the lateral plate edges of the receiving plate forming the shelf.

Conventional holding struts have one or more hook structures by means of which they can be fitted into holding or mounting openings which are provided on the rear wall of the cold chamber. In the case of conventional shelf assemblies, the receiving plate is supported on the lateral holding struts, and the holding struts are in turn supported on the cold chamber rear wall or on a metallic carrying structure concealed behind a rear wall lining. The holding struts are often referred to in English as brackets.

For the prior art in respect of conventional shelf assemblies reference is made by way of example to the following specifications: U.S. Pat. No. 5,034,861; WO 2014/205352 A1; US 2015/0216062 A1; U.S. Pat. No. 8,899,704 B2; U.S. Pat. No. 8,322,873 B2; U.S. Pat. No. 8,596,205 B2; US 2014/0217879 A1; US 2014/0376213 A1; and EP 3 147 607 A1.

In order that they can perform the function of electric current conduction, the brackets conventionally have an iron-based metal material. The current supply to the brackets conventionally takes place from the carrying structure into the brackets. Electrical contact points, at which an electrical contact between the brackets and the carrying structure is closed when the brackets are fitted into the mounting openings, are located in the case of conventional forms of the brackets, for example, at the hook structures and at additional rigid support surfaces which are provided on the brackets at a distance beneath the hook structures and stabilize the brackets against falling down. In the fitted state, force deflection from the brackets into the carrying structure takes place both via the hook structures and via the rigid support surfaces.

For a reliable current supply to and electrical control of the electrical consumers accommodated in the trim, a good electrical contact at the contact points between the brackets and the carrying structure is to be ensured.

SUMMARY OF THE INVENTION

It is an object of the invention to provide a solution which is simple structurally and in terms of production for ensuring good electrical contact between a holding strut of a shelf assembly and a carrying structure to which the shelf assembly can be fitted.

In achieving this object, the invention starts from a shelf assembly which comprises a receiving plate having a front plate edge, a rear plate edge and two lateral plate edges, and a holding strut on at least one of the lateral plate edges for supporting the receiving plate. The holding strut has in the region of a rear strut end at least one hook structure for fitting the holding strut into a mounting opening of a carrying structure. At a distance beneath the hook structure, the holding strut forms a first support structure for support on a front side, facing the strut, of the carrying structure. According to the invention, in such a shelf assembly the holding strut is characterized in that, in the region of the rear strut end, at a distance above the first support structure, it provides a resiliently deflectable second support structure for support on the front side, facing the strut, of the carrying structure. The resilient deflectability of the second support structure makes it possible to ensure better defined mechanical contact and thus better defined electrical contact between the holding strut and the carrying structure on fitting of the holding strut into the carrying structure. In this manner, the reliability of the electrical contacting of the holding strut, when the holding strut is fitted into the carrying structure, can be improved.

In some embodiments, the second support structure is arranged between the hook structure and the first support structure. The second support structure can thereby be arranged closer to the hook structure than to the first support structure.

In some embodiments, the second support structure is resiliently deflectable in a plane which is substantially perpendicular to the plate plane of the receiving plate and runs parallel to the lateral plate edges.

In some embodiments, the holding strut has a strut body extending along the lateral plate edge in question, wherein the hook structure, the first support structure and the second support structure are integral parts of the strut body.

The second support structure—when viewed in a section perpendicular to the plate plane of the receiving plate and running parallel to the lateral plate edges—can have an elongate spring limb extending at a sloping angle to a plate normal of the receiving plate, which spring limb forms in the region of a free limb end a support foot for support on the carrying structure.

In some embodiments, the strut body is manufactured from a surface-coated metal material, in particular iron material. The strut body, at least at the hook structure and at the second support structure, in particular also at the first support structure, forms contact points that are locally freed of the surface coating for the electrical contacting of the carrying structure. Consequently, in these embodiments there is used for the electrical contacting of the holding strut not only the hook structure but additionally the resilient second support structure. Apart from its mechanical function for ensuring better defined mechanical contact between the hook structure and the carrying structure, the second support structure in the embodiments in question consequently additionally has an electrical contacting function.

The iron material can be, for example, raw iron or a steel, wherein both low-alloy and high-alloy steel materials (in particular stainless steel) are suitable.

In some embodiments, the strut body is in the form of a flat body. For example, a strut preform can be cut or stamped from sheet-metal material in order to produce the strut body. This strut preform can then be surface-coated, for example by powder coating or anodization.

In some embodiments, the shelf assembly further comprises a cover strip, arranged at the front plate edge of the receiving plate and extending at least over a large part of the length, in particular substantially over the entire length, of the front plate edge, as a carrier of at least one electrical consumer, wherein the holding strut is located in an electric circuit which leads to the electrical consumer. The electrical consumer can be formed, for example, by one or more lighting means, for example light emitting diodes.

According to a further aspect, the invention provides a storage arrangement for items of everyday life (in particular foodstuffs) or household items. The storage arrangement can be, for example, a domestic cooling device. The term cooling device will here be understood in the sense of a device which serves to store foodstuffs above or/and below the freezing point, that is to say in the frozen state or in the unfrozen state, wherein the storage temperature is in any case below the room temperature outside the cooling device. As an alternative to a cooling device, the storage arrangement can be, for example, a domestic fitment such as, for example, a storage rack, in which the shelf assembly forms a rack compartment of the storage rack. The storage arrangement comprises a carrying structure having a plurality of mounting openings arranged at a mutual distance one above the other, and a shelf assembly of the type discussed hereinbefore. In the case of the fitting of the hook structure of the holding strut of the shelf assembly into a mounting opening above a lowermost of the mounting openings, the hook structure and the second support structure are supported on opposite wall sides of a first wall portion, located between the mounting opening and a next lower mounting opening, of the carrying structure. The first support structure, on the other hand, is supported on a second wall portion, located beneath the next lower mounting opening, of the carrying structure.

According to yet a further aspect, the invention provides a holding strut for supporting a receiving plate, comprising a strut body in the form of a flat body having a strut form which—when viewed in a plan view of a flat side of the flat body—tapers from a first strut end to an opposite second strut end, wherein the strut body has in the region of its first strut end a hook structure for the fitting of the holding strut into a mounting opening of a carrying structure and, at a distance from the hook structure, forms a first support structure for support on a front side, facing the strut, of the carrying structure. According to the invention, the strut body provides in the region of the first strut end a resiliently deflectable second support structure for support on the front side, facing the strut, of the carrying structure, wherein the second support structure is arranged offset with respect to the first support structure in the direction towards the hook structure.

Apart from its mechanical function for providing a spring biasing force, the second support structure can have an electrical contacting function. Accordingly, it is provided in some embodiments that the strut body is manufactured from a surface-coated metal material, in particular iron material, and the strut body forms at the second support structure, if desired also at the hook structure or/and at the first support structure, a contact point that is locally freed of the surface coating for the electrical contacting of the carrying structure.

In some embodiments, the strut body is manufactured from sheet-metal material. The second support structure can thereby be formed by cutting or stamping of the sheet-metal material.

The invention will be explained further hereinbelow with reference to the accompanying drawings.

DETAILED DESCRIPTION OF THE INVENTION

Figure 1:
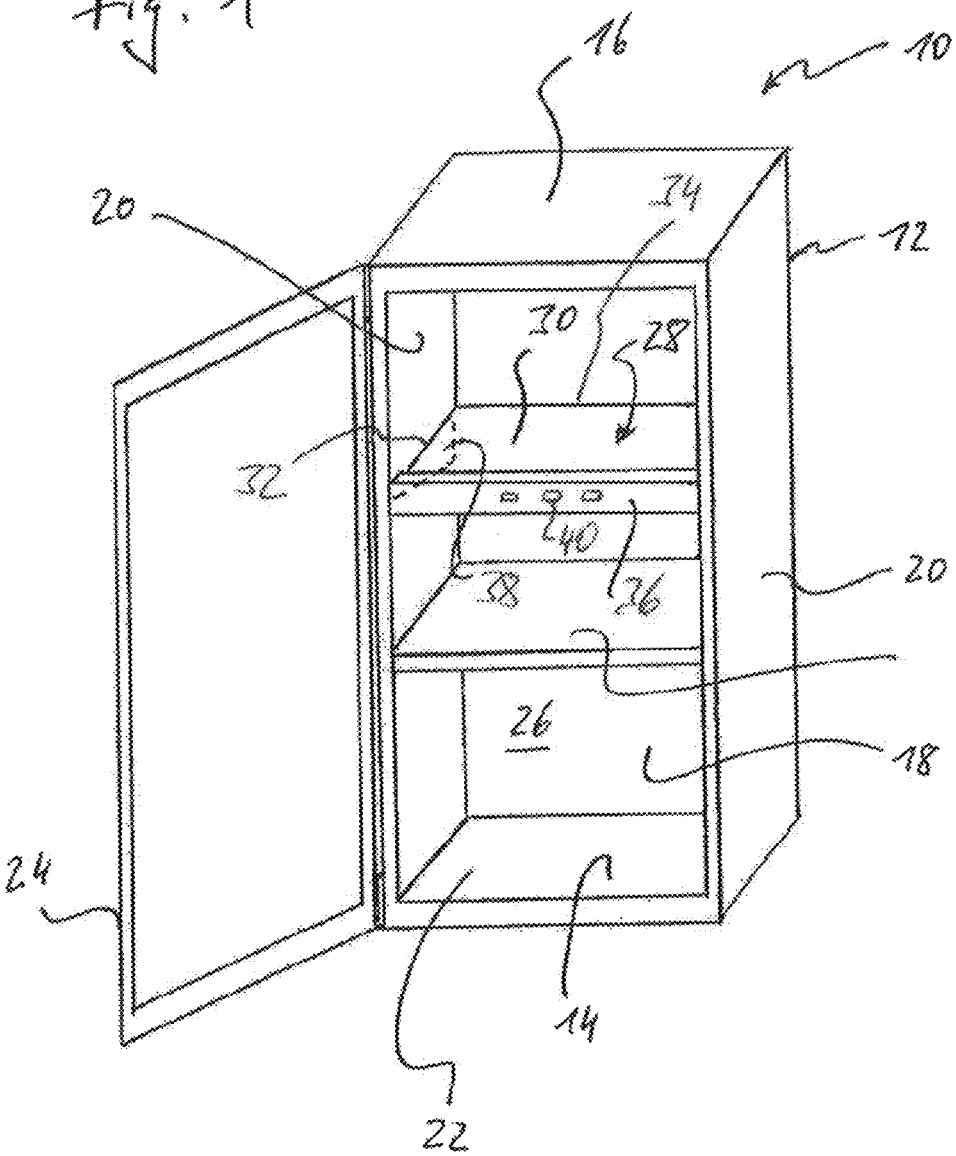
FIG. 1 is a perspective view of a domestic cooling device according to an exemplary embodiment with the door open.

Reference will first be made to FIG. 1. The domestic cooling device shown therein is designated generally 10. It is a device of cabinet construction which serves for the cold or frozen storage of foodstuffs and has a cabinet body 12 having a bottom wall 14, a top wall 16, a rear wall 18 and two side walls 20. The cabinet body 12 forms an access opening 22 which is bordered by the bottom wall 14, the top wall 16 and the two side walls 20 and which can be closed by a cabinet door 24 which is articulated with one of the side walls 20 so as to be pivotable about a vertical pivot axis. An interior 26 (cold chamber) of the cooling device 10 is accessible for a user through the access opening 22.

The interior of the cooling device 10 can be or is capable of being equipped with a wide variety of built-in parts which are suitable for receiving and holding foodstuffs. At least one of these built-in parts is a shelf assembly 28, which has as the central component a receiving plate 30 which serves as a shelf and is manufactured, for example, from a transparent glass or plastics material.

The receiving plate 30 has, in a flat-side plan view, a rectangular outline with lateral plate edges 32, a rear plate edge 34 and a front plate edge, which in the view of FIG. 1 is concealed by a front protective strip 36 and is therefore not specifically provided with a reference numeral. In the installed situation of the shelf assembly 28, the lateral plate edges 32 (only one of which is shown in FIG. 1, because the other is concealed by one of the side walls 20 of the cabinet body 12) are located adjacent to the side walls 20, the rear plate edge 34 is located adjacent to the rear wall 18, and the front plate edge is located opposite the rear plate edge 34.

The shelf assembly 28 additionally comprises two holding struts 38, each of which is arranged in the region of one of the lateral plate edges 32 of the receiving plate 30 and only one of which is shown by a broken line in FIG. 1. In the example shown, the holding struts 38, so-called brackets, extend in the longitudinal direction of the lateral plate edge 32 in question in each case over at least a large part of the depth of the receiving plate 30 and in particular substantially over the entire depth of the receiving plate 30 (measured from the front plate edge to the rear plate edge 34). They make it possible to mount the shelf assembly 28 releasably (i.e. so that it can be removed again) on the rear wall 18 of the cabinet body 12. The receiving plate 30 is fixedly connected to the holding struts 38, for example by an adhesive bond. The holding struts 38 act as carrying arms for the receiving plate 30, which are supported in the region of the their rear arm ends on the rear wall 18 and otherwise protrude freely. It is apparent simply from the view of FIG. 1 that the holding struts 38—when viewed normally to the side walls 20—have a strut form which becomes narrower in the direction from the rear plate edge 34 to the front plate edge of the receiving plate 30.

The protective strip 36 (trim) on the one hand provides mechanical protection for the front plate edge of the receiving plate 30, on the other hand it has an illuminating function. For this purpose, in the example shown a plurality of lighting elements 40 are accommodated in the protective strip 36, which lighting elements are arranged in an electric circuit in which the holding struts 38 are also incorporated. The lighting elements 40 represent an electrical consumer that is integrated into the shelf assembly 28. It will be appreciated that the number of lighting elements 40 shown in FIG. 1 is purely by way of example. For example, there can be accommodated in the protective strip 36 a strip formed by a flexible printed circuit board on which a plurality of light emitting diodes forming the lighting elements 40 are mounted one behind the other in the strip longitudinal direction. Such lighting strips are commercially available and do not require further explanation at this point. In the example shown, the protective strip extends substantially over the entire width of the receiving plate 30, that is to say from one of the lateral plate edges 32 to the opposite lateral plate edge. Examples of forms of the protective strip 36 are shown in DE 10 2018 002 685 A1 and DE 10 2015 007 839 A1, the content of each of which is incorporated herein by reference.

Figure 2A:
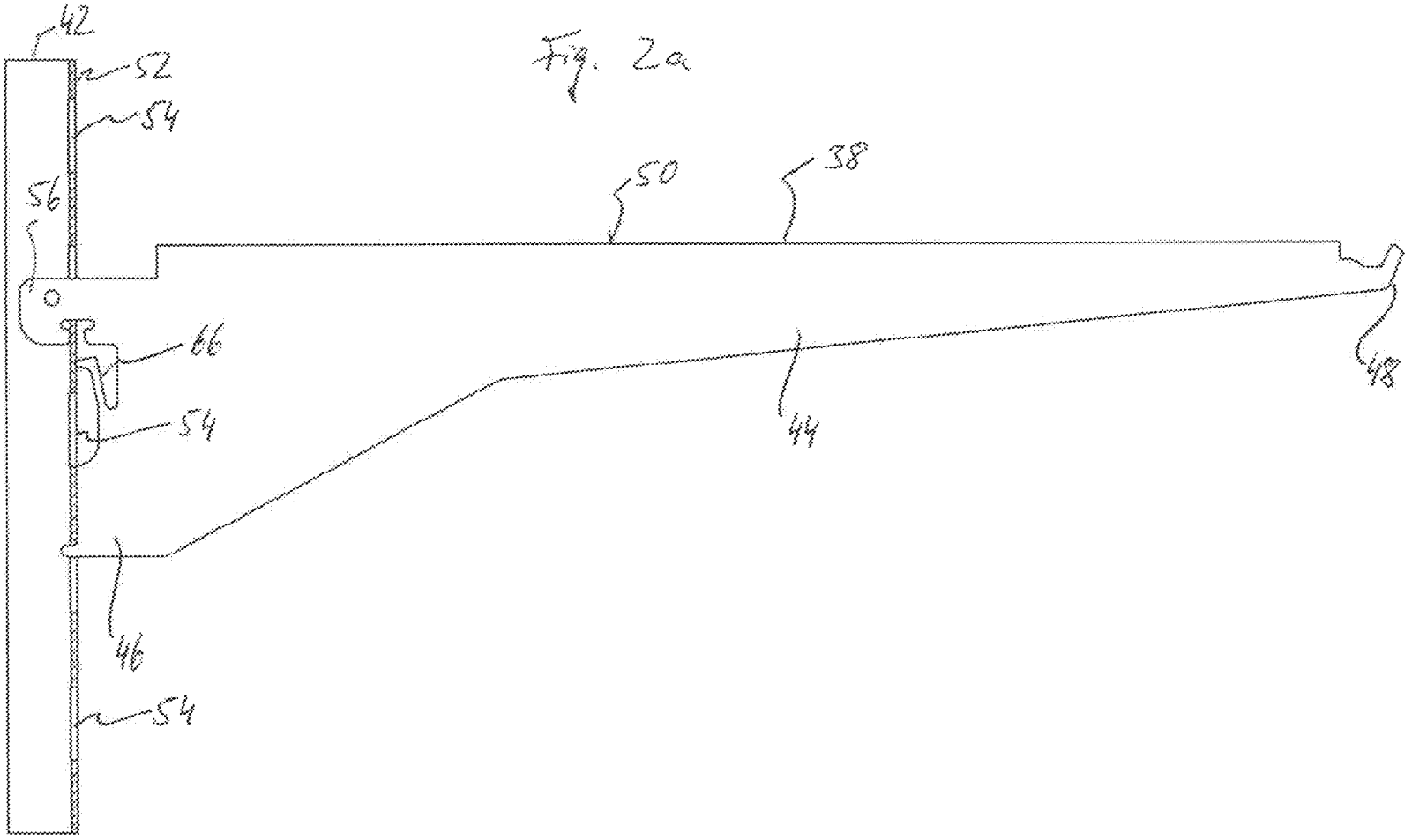
FIG. 2*a* is a view of a holding strut of a shelf assembly according to an exemplary embodiment in a state fitted to a carrying structure.
Figure 2B:
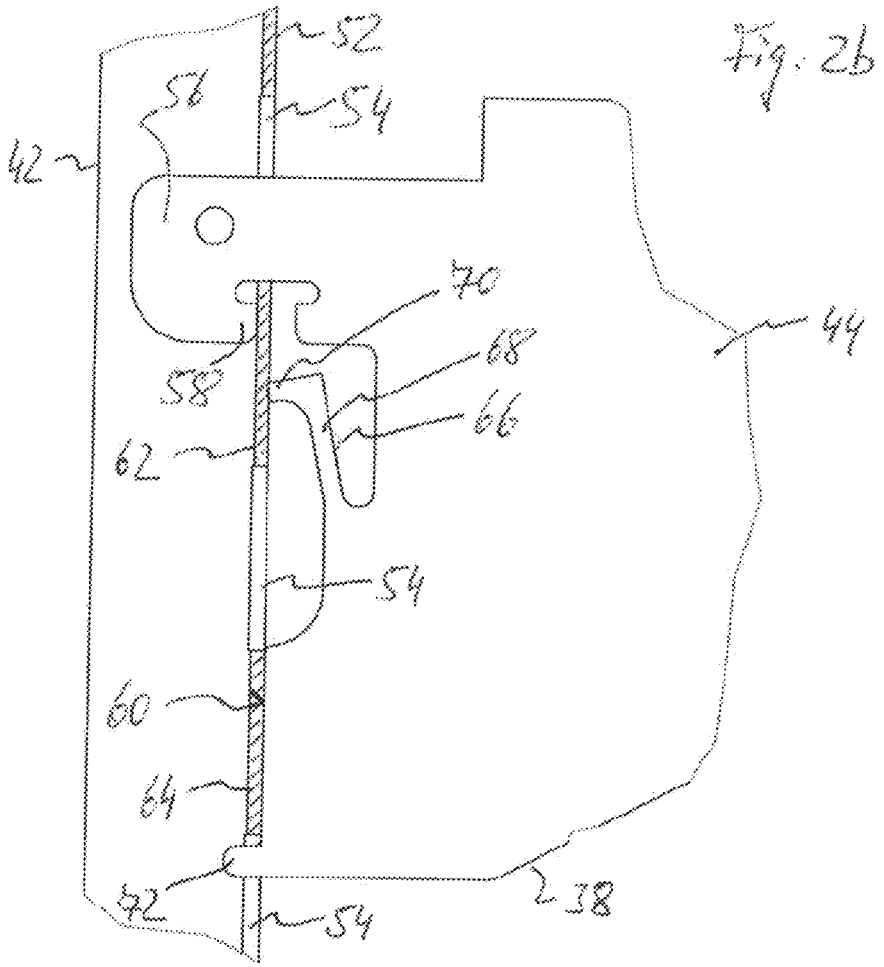
FIG. 2*b* shows an enlarged detail of FIG. 2*a*.

Reference will now be made to FIGS. 2*a* and 2*b*. These figures show a concrete exemplary embodiment of the holding strut 38 of FIG. 1. In the situation shown in FIGS. 2*a*, 2*b*, the holding strut 38 is fitted to a carrying structure 42 which can be formed by the rear wall 18 of the cabinet body 12 of FIG. 1 or can comprise the rear wall 18. Each of the holding struts 38 has a strut body 44, which is in the form of a flat body and is formed, for example, by a surface-coated sheet-iron part. Within the scope of the present disclosure, the term sheet iron is also to include sheet steels. The strut body 44 can be produced by cutting or stamping a strut preform from a sheet-metal material supply and then surface coating (for example by powder coating, by anodization or by application of a colored paint) the strut preform so formed. If desired, the strut preform can also be subjected to bending if the planar form of the strut preform after cutting or stamping from the sheet-metal material supply does not yet represent the final form of the strut body 44. Regardless of any such bending, the strut body 44 remains a flat body with a main plane which lies parallel to the plane of the drawing in the view of FIGS. 2*a*, 2*b*. FIGS. 2*a*, 2*b* accordingly show the strut body 44 in a plan view of a flat side of the strut body 44.

The strut body 44 has a rear strut end 46 and a front strut end 48. The terms rear and front relate to the view of a user standing in front of the open refrigerator 10 in FIG. 1 and looking into the cooling chamber 26. In the region of its rear strut end 46, the strut body 44 is fitted to the carrying structure 42. Only there is it supported. Otherwise, the strut body 44 protrudes freely over its entire strut length to its front strut end 48. The strut body 44 is comparatively broad at its rear strut end 46, it becomes narrower and tapers in the direction towards its front strut end 48.

On its strut upper side the strut body 44 forms a planar receiving surface 50 for a receiving plate (not shown in FIGS. 2*a*, 2*b*) with which the strut body 44 is to be coupled in order to produce a shelf assembly. The connection of the strut body 44 to the receiving plate, which is, for example, the receiving plate 30 of FIG. 1, is undetachable, that is to say permanently fixed, in some embodiments and can be produced, for example, by adhesive bonding. In the finally mounted state of the shelf assembly, the plate plane of the receiving plate is perpendicular to the plane of the drawing of FIGS. 2*a*, 2*b*.

As is apparent especially from FIG. 2*b*, the carrying structure 42 forms a supporting wall 52 in which there are formed a plurality of mounting openings 54 arranged one above the other in the vertical direction (vertical in relation to the normal use position of the refrigerator 10). The mounting openings 54 allow the strut body 44 to be fitted to the carrying structure 42. The presence of a plurality of mounting openings 54 allows the shelf assembly 28 to be inserted into the refrigerator 10 at different heights. After the shelf assembly 28 has been equipped with a holding strut 38 in the region of each of its two lateral plate edges 32, a row of mounting openings 54 arranged one above the other is advantageously formed in the supporting wall 52 in association with each of the holding struts 38. It will be appreciated that, in other embodiments, only a single possible height position can be specified for the fitting of the shelf assembly 28. Accordingly, in such other embodiments, the carrying structure 42 can provide only a single mounting opening 54 in association with each holding strut 38. However, in the example shown—as mentioned—a plurality of mounting openings 54 in association with each holding strut 38 are provided one above the other.

The supporting wall 52 is manufactured from a metallic, current-conducting material, so that, via the supporting wall 52, electric current conduction from the carrying structure 42 into the strut body 44 and from the strut body into the protective strip 36 to the electrical consumers therein is possible. For example, the carrying structure 42 comprises for this purpose a metal profile rail which is provided with the mounting openings 54 in one of its profile walls. The profile rail has, for example, a U-shaped cross-section, wherein the middle, shorter limb of the U forms the supporting wall 52 and is provided with the mounting openings 54.

The strut body 44 is designed with at least one hook structure 56 with which the strut body 44 can be introduced into one of the mounting openings 54 and can be fitted therein. The hook structure 56 forms a hook nose 58 which, on fitting of the strut body 44, comes into supporting contact with the rear side, remote from the strut, of the supporting wall 52. In some embodiments, the surface coating of the strut body 44 is removed locally at least in the region of the hook nose 58, so that an electrically conducting contact region is produced by contact of the hook nose 58 with the supporting wall 52.

The strut body 44 additionally forms, at a distance beneath the hook structure 56, an abutment surface 60 with which the strut body 44, when it is mounted on the carrying structure 42, is supported on the front side, facing the strut, of the supporting wall 52. The abutment surface 60 forms a first support structure within the meaning of the present disclosure. In some embodiments, the surface coating of the strut body 44 is removed locally also in the region of the abutment surface 60, so that a further electrically conducting contact region is produced by contact of the abutment surface 60 with the supporting wall 52.

It will be seen from FIG. 2*b* that, in the example shown, the abutment surface 60 is supported on a wall portion 62 of the supporting wall 52 that is located beneath a next lower mounting opening 54 with respect to the mounting opening 54 into which the hook structure 56 has been introduced. The mounting opening 54 into which the hook structure 56 has been introduced, and the mentioned next lower mounting opening 54, are separated in the example of FIG. 2*b* by a wall portion 64 of the supporting wall 52. The hook nose 58 of the hook structure 56 is supported on the rear side on this wall portion 64. The abutment surface 60, on the other hand, is supported on the wall portion 62, that is to say still beneath a mounting opening 54 that is located beneath the mounting opening 54 into which the hook structure 56 has been introduced.

Between the hook structure 56 and the abutment surface 60, the strut body 44 additionally forms a biasing contact structure 66, which is an integral part of the strut body 44 and—like the hook structure 56 and the abutment surface 60—is produced as the result of the cutting or stamping of the sheet-metal material from which the strut preform is formed. The biasing contact structure 66 forms a second support structure within the meaning of the present disclosure. It serves to generate a spring biasing force, which is to improve the quality of the contact between the hook nose 58 and the wall portion 64 and thus the reliability of the electrical contacting of the wall portion 64 by the hook nose 58. In the mounted state of the holding strut 38, the biasing contact structure 66 is supported on the front side, facing the strut, of the supporting wall 52, namely specifically on the front side of the wall portion 64 on which the hook nose 58 is also supported. It will be seen in particular from the view of FIG. 2*b* that the biasing contact structure 66 lies against the wall portion 64 slightly below the hook nose 58, wherein the point of contact of the biasing contact structure 66 on the wall portion 64 is considerably closer to the hook nose 58 than to the abutment surface 60.

The biasing contact structure 66 has an elongate leg portion 68 protruding from adjoining regions of the strut body 44. The leg portion serves as a spring limb (or spring leg). At the free leg end of the leg portion 68 there is formed a support foot 70 with which the biasing contact structure 66 is supported on the wall portion 64 in the mounted state of the holding strut 38. The leg portion 68 with the support foot 70 is resiliently deflectable in the main plane of the strut body 44, that is to say in the plane of the drawing of FIG. 2*b*. In some embodiments, electrically conducting contact is established between the support foot 70 and the wall portion 64, for which purpose the surface coating of the strut body 44 can be locally removed in the region of the support foot 70 so that metal-to-metal contact between the support foot 70 and the wall portion 64 is possible. In the example shown, the leg portion 68 projects upwards towards the rear at a sloping angle in order to achieve a vertical distance from the support foot 70 to the hook nose 58 that is as small as possible.

Beneath the abutment surface 60 the strut body 44 in the example shown has a rearwardly projecting centering nose 72 which, on mounting of the holding strut 38, enters a mounting opening 54 located beneath the wall portion 62 in order to ensure lateral fixing of the holding strut 38.

Figure 3:
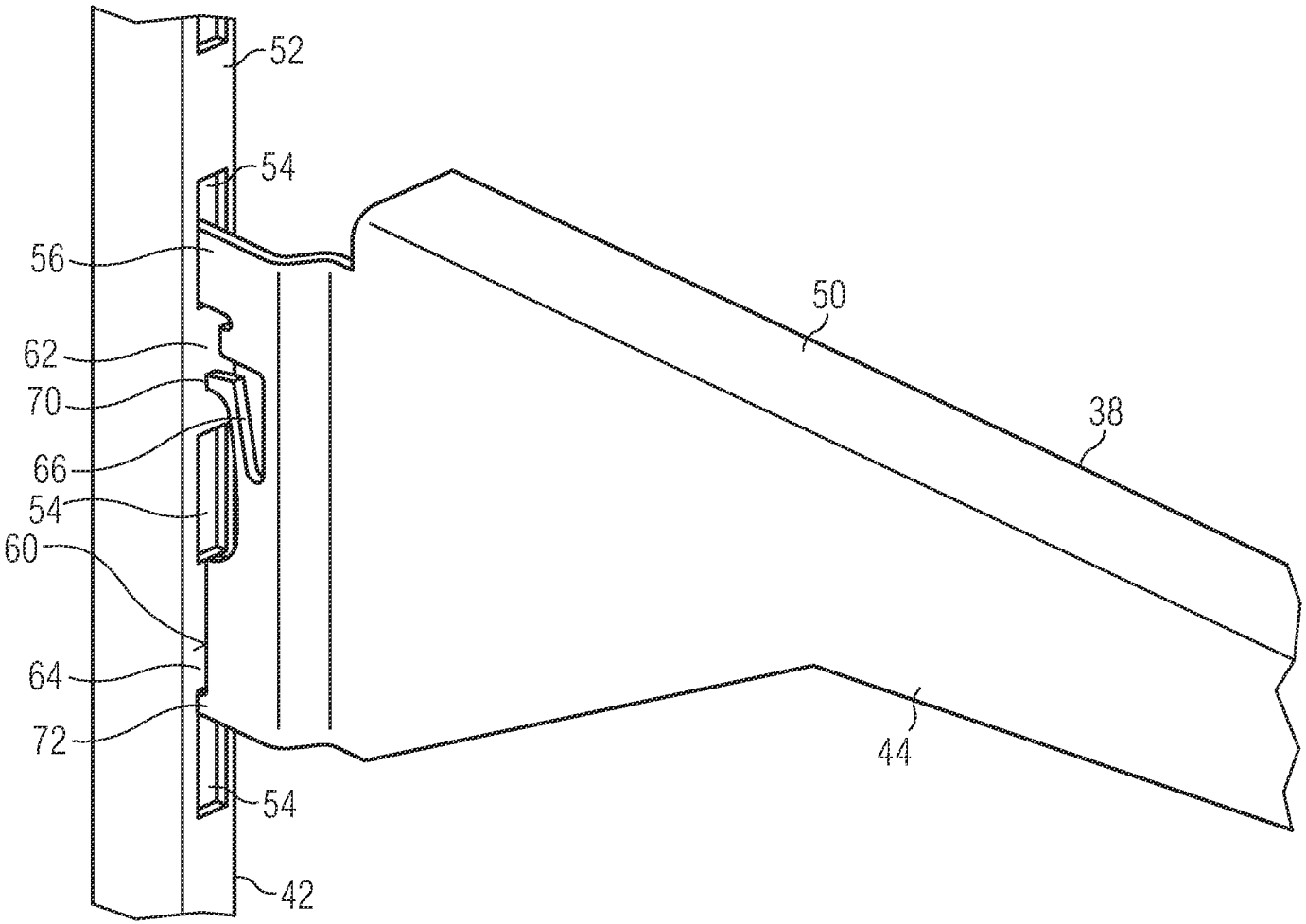
FIG. 3 is a perspective view of the holding strut of FIGS. 2*a*, 2*b* in the state mounted on the carrying structure.

The mounted state of the holding strut 38 on the carrying structure 42 with the biasing contact structure 66 lying resiliently against the wall portion 64 is clearly visible in the perspective view of FIG. 3.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A shelf assembly for a domestic cooling device, comprising:

a receiving plate having a front plate edge, a rear plate edge and two lateral plate edges; and a holding strut on at least one of the lateral plate edges for supporting the receiving plate, wherein the holding strut has in a region of a rear strut end at least one hook structure for fitting the holding strut into a mounting opening formed in a front side of a carrying structure and, at a distance beneath the hook structure, forms a first support structure for support on a front side, facing the strut, of a supporting wall of the carrying structure, and the holding strut is configured to protrude freely from the rear strut end to a front strut end in a mounted state of the holding strut, wherein the holding strut, in the region of the rear strut end, at a distance above the first support structure, provides a resiliently deflectable second support structure for support on the front side, facing the strut, of the supporting wall of the carrying structure, wherein the first support structure is formed by a plane abutment surface which is substantially perpendicular to a plate plane of the receiving plate and which forms part of the rear strut end, and wherein the second support structure—when viewed in a section perpendicular to the plate plane of the receiving plate and running parallel to the lateral plate edges—has an elongate spring limb extending at a sloping angle to a plate normal of the receiving plate, wherein the elongate spring limb has a spring leg and a support foot forming a free end of the spring limb, wherein the elongate spring limb is configured to abut resiliently against the front side of the supporting wall of the carrying structure with an outer rear end of the support foot, wherein the elongate spring limb with its free limb end is inclined towards the rear strut end in a plane substantially perpendicular to the plate plane of the receiving plate and running parallel to the lateral plate edges thereby being configured to provide a spring biasing force in the plane perpendicular to the plate plane of the receiving plate and running parallel to the lateral plate edges for enhancing a mechanical contact between the holding strut and the carrying structure in a mounted state of the holding strut when the elongate spring limb is deflected so as to resiliently abut against the front side of the supporting wall.

2. The shelf assembly as claimed in claim 1, wherein the second support structure is arranged between the hook structure and the first support structure.

3. The shelf assembly as claimed in claim 2, wherein the second support structure is arranged closer to the hook structure than to the first support structure.

4. The shelf assembly as claimed in claim 1, wherein the second support structure is resiliently deflectable in a plane which is substantially perpendicular to the plate plane of the receiving plate and runs parallel to the lateral plate edges.

5. The shelf assembly as claimed in claim 1, wherein the holding strut has a strut body extending along the lateral plate edge, and wherein the hook structure, the first support structure and the second support structure are integral parts of the strut body.

6. The shelf assembly as claimed in claim 5, wherein the strut body is manufactured from a surface-coated metal material, and, at the hook structure and at the second support structure, forms contact points that are locally freed of the surface coating for the electrical contacting of the carrying structure.

7. The shelf assembly as claimed in claim 5, wherein the strut body is in the form of a flat body and is produced by cutting or stamping a strut preform from sheet-metal material.

8. The shelf assembly as claimed in claim 1, further comprising a cover strip, arranged at the front plate edge of the receiving plate and extending substantially over the entire length of the front plate edge, as a carrier of at least one electrical consumer, wherein the holding strut is located in an electric circuit which leads to the electrical consumer.

9. A storage arrangement for household items, in particular a domestic cooling device, the storage arrangement comprising:

a carrying structure having a plurality of mounting openings arranged at a mutual distance one above the other; and a shelf assembly as claimed in claim 1, wherein in the case of the fitting of the hook structure of the holding strut of the shelf assembly into a mounting opening above a lowermost of the mounting openings, the hook structure and the second support structure are supported on opposite wall sides of a first wall portion, located between the mounting opening and a next lower mounting opening, of the carrying structure, and the first support structure is supported on a second wall portion, located beneath the next lower mounting opening, of the carrying structure.

10. A holding strut for supporting a receiving plate, the holding strut comprising:

a strut body in the form of a flat body having a strut form which—when viewed in a plan view of a flat side of the flat body—tapers from a first strut end to an opposite second strut end, wherein the strut body has in a region of said first strut end a hook structure for the fitting of the holding strut into a mounting opening of a carrying structure and, at a distance from the hook structure, forms a first support structure for support on a front side, facing the strut, of the carrying structure, wherein the strut body provides in the region of the first strut end a resiliently deflectable second support structure for lying with a free end against the front side, facing the strut, of the carrying structure thereby providing a spring biasing force for enhancing a mechanical and electrical contact between the holding strut and the carrying structure in a mounted state of the holding strut, wherein the second support structure is arranged offset with respect to the first support structure in the direction towards the hook structure, wherein the strut body is manufactured from a surface-coated metal material, and the strut body forms at the second support structure an electrically conducting contact point that is locally freed of the surface coating for the electrical contacting of the carrying structure.

11. The holding strut as claimed in claim 10, wherein the strut body forms at the hook structure or/and at the first support structure an electrically conducting contact point that is locally freed of the surface coating for the electrical contacting of the carrying structure.

12. The holding strut as claimed in claim 10, wherein the strut body is manufactured from sheet-metal material and the second support structure is formed by cutting or stamping of the sheet-metal material.

13. A shelf assembly for a domestic cooling device, comprising:

a receiving plate having a front plate edge, a rear plate edge and two lateral plate edges; and a holding strut on at least one of the lateral plate edges for supporting the receiving plate, wherein the holding strut has in a region of a rear strut end at least one hook structure for fitting the holding strut into a mounting opening of a carrying structure and, at a distance beneath the hook structure, forms a first support structure for support on a front side, facing the strut, of the carrying structure, wherein the first support structure forms part of the rear strut end, wherein the holding strut, in the region of the rear strut end, at a distance above the first support structure, provides a resiliently deflectable second support structure for lying resiliently with a free end against the front side, facing the strut, of the carrying structure thereby providing a spring biasing force for enhancing a mechanical and electrical contact between the holding strut and the carrying structure in a mounted state of the holding strut, wherein the holding strut has a strut body that is formed of a surface-coated metal material and forms at the hook structure an electrically conductive contact point that is locally freed of the surface coating for the electrical contacting of the carrying structure.

* * * * *